US007809302B2

(12) United States Patent
Choi

(10) Patent No.: US 7,809,302 B2
(45) Date of Patent: Oct. 5, 2010

(54) CHARGING DEVICE AND IMAGE FORMING APPARATUS USING THE SAME

(75) Inventor: Jeong-jai Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 194 days.

(21) Appl. No.: 12/125,200

(22) Filed: May 22, 2008

(65) Prior Publication Data

US 2009/0074443 A1 Mar. 19, 2009

(30) Foreign Application Priority Data

Sep. 14, 2007 (KR) ..... 10-2007-0093670

(51) Int. Cl.
*G03G 15/02* (2006.01)

(52) U.S. Cl. ..... 399/89; 361/225

(58) Field of Classification Search ..... 399/89, 399/100, 50; 361/225, 230, 235
See application file for complete search history.

(56) References Cited

U.S. PATENT DOCUMENTS

| | | | | |
|---|---|---|---|---|
| 6,449,446 | B2 * | 9/2002 | Kashihara | 399/89 |
| 2006/0147227 | A1 * | 7/2006 | Lee et al. | 399/176 |
| 2007/0172251 | A1 * | 7/2007 | Suganuma et al. | 399/100 |

* cited by examiner

*Primary Examiner*—Constantine Hannaher
(74) *Attorney, Agent, or Firm*—Stanzione & Kim, LLP

(57) ABSTRACT

A charging apparatus includes a charging member to charge a surface of a photoconductive medium, a power unit to supply an electric power as a bias voltage to the charging member, and a resistor unit to reduce a ripple on the surface of the charging member. Accordingly, a stability of the charging apparatus is secured without using a separate power device.

20 Claims, 2 Drawing Sheets

CHARGING DEVICE AND IMAGE FORMING APPARATUS USING THE SAME

CROSS-REFERENCE TO RELATED APPLICATIONS

This application claims priority under 35 U.S.C. § 119 (a) from Korean Patent Application No. 10-2007-0093670, filed on Sep. 14, 2007, in the Korean Intellectual Property Office, the disclosure of which is incorporated herein by reference in its entirety.

BACKGROUND OF THE INVENTION

1. Field of the Invention

The present general inventive concept relates to a charging device and an image forming apparatus using the same, and more particularly, to a charging device capable of stabilizing a charging potential, and an image forming apparatus using the same.

2. Description of the Related Art

Various types of image forming apparatus are available to form an image on a medium, and these are mainly categorized according to a printing method into a dot printer, an inkjet printer, and a laser printer. The laser printer is superior to the dot printer or the inkjet printer, in that it has a faster printing speed, and better printing quality. Therefore, the image forming apparatuses applying a laser printing method are most widely used.

An image forming apparatus using the laser printing method subsequently operates in the steps of primary charge, exposure, development, transferring, and fusing. Such an image forming apparatus adopts an image forming method in which a negative charge is applied to a surface of an organic photoconductive unit (OPC), and the property of the OPC allows a latent image to be written to a drum surface of the OPC via a laser beam emitted from a laser scanning unit (LSU). The toner is then affixed on the latent image which is later developed into a visual image, the image is transferred to a printing medium, and the image is bonded or fixed to the printing medium by heat and pressure. As a result, the above-described printing operation is completed.

The charging process of the printing operation includes electrical-charging a photoconductive medium surface with a negative charge using corona discharge. In specific, the photoconductive medium is charged with the negative charge through a discharge potential voltage of a charging member-charging member which is positioned at a fore end of an exposure area prior to scanning a laser beam. However, the use of the corona discharge alone to charge the electric charge in the charging process would cause ripple due to an inconstant charging voltage. The ripple of the charging potential induces a problem of a defective image output.

FIG. 1 is a waveform view illustrating variation of a charging voltage of a conventional charging membercharging member.

Referring to FIG. 1, a conventional charging device has a ripple having potential difference between 20V and 30V in a process to charge a potential −600V on a surface of a photoconduction medium. The ripple of the charging potential causes to degrade printing quality especially when printing is performed at high speed, or when a high resolution image is printed.

Conventionally, AC power is supplied to an image forming apparatus to obviate such defects, so that a constant surface potential is applied to the photoconductive medium. Although the ripple of the charging potential is improved, a user still experiences inconvenience because it is necessary to use a high AC voltage separately. As additional power devices are required for an image forming apparatus, it is difficult to miniaturize the image forming apparatus. Accordingly, the freedom of design is deteriorated.

SUMMARY OF THE INVENTION

The present general inventive concept provides a charging device in which stabilization of a charging potential is improved by using a resistance so that power is stably supplied without an additional power device and an image forming apparatus using the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a charging apparatus, including a charging member to charge a surface of a photoconductive medium, a power unit to supply an electric power to the charging member, and a resistor unit to reduce a ripple on the surface of the charging member.

The resistor unit may be connected in parallel with the charging member.

The power unit may be an electric power source in which an end is connected with a conductive member facing with the charging member and a rotation axis of the charging member.

The apparatus may further include a cleaning member to clean the surface of the charging member; and a conductive member facing with the charging member at a rear end of the cleaning member based on a rotational direction of the charging member.

The potential difference may be approximately 600 V.

The foregoing and/or other aspects and utilities of the present general inventive concept may also be achieved by providing an image forming apparatus, including a photoconductive medium, and a charging apparatus that an electric power is supplied to a charging member, and to reduce a ripple of the charging member The charging apparatus may further include a resistor unit connected in parallel with the charging member.

The charging apparatus may be an electric power source in which an end is connected with a conductive member facing with the charging member and a rotation axis of the charging member.

The apparatus may further include a cleaning member to clean the surface of the charging member, and a conductive member at facing with the charging member a rear end of the cleaning member based on a rotational direction of the charging member.

The foregoing and/or other aspects and utilities of the present general inventive concept may also be achieved by providing a charging apparatus usable with an image forming apparatus, including a charging member, and a power device to supply a first electric power to a first portion of the charging member and to supply a second electric power to a second portion of the charging member.

The first portion of the charging member may include a shaft terminal to receive the first electric power of the power device.

The second portion of the charging member may include a surface to receive the second electric power of the power device.

The charging member may have a resistance between the first portion and the second portion.

The power device may include a DC bias unit to generate the first electric power to be supplied to the first portion of the charging member, and a resistor unit to reduce the first electric power of the DC bias unit to the second electric power to be supplied to the second portion of the charging member.

The power device may include a conductor member through which the second electric power of the power device is supplied to the second portion of the charging unit.

The power device may include a conductor member being in area contact with the second portion of the charging member to supply the second electric power to the second portion of the charging member.

The power device may include a brush disposed to contact the second portion of the charging member.

The second portion of the charging member may include an outer surface to contact an external photoconductive medium through a nip area, and the power device may include a conductive element having an area disposed along the outer surface of the charging member.

The conductive element may have a width to correspond to a width of the charging member in a direction parallel to a rotation axis of the charging member.

The first portion of the charging member may include a shaft to rotate with respect to a rotation axis thereof to be in point contact with the power device to receive the first electric power, and the second portion of the charging member may include a surface to be in area contact with the power device to receive the second electric power.

The second portion of the charging member may be in contact with a photoconductive medium to charge a surface of the photoconductive medium with a potential using the first electric power and the second electric power, and the second electric power may be supplied to the second portion of the charging member to reduce ripple of the potential of the surface of the photoconductive medium.

The second portion of the charging member may contact the power device to receive the second electric power and then contact an external photoconductive medium through a nip area to reduce an electrical ripple of a surface of the photoconductive medium.

The charging member may include a medium disposed between the first portion and the second portion, and the second portion of the charging member may be supplied with the first electric power through the medium and with the second electric power through a conductive medium.

The power device may simultaneously supply the first electric power and the second electric power to the first portion and the second portion, respectively.

The foregoing and/or other aspects and utilities of the present general inventive concept may also be achieved by providing an image forming apparatus including a photoconductive medium to be formed with a latent image, and a charging apparatus having a charging member to charge the photoconductive medium, and a power device to supply a first electric power to a first portion of the charging member and to supply a second electric power to a second portion of the charging member to reduce an electrical ripple of the photoconductive medium when charging the photoconductive medium.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
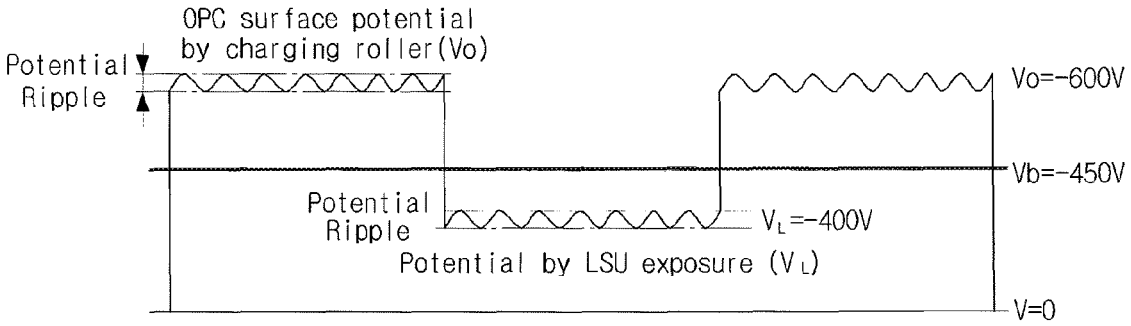
FIG. 1 (PRIOR ART)
FIG. 1 is a waveform view illustrating variation of a charging voltage of a conventional charging member.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
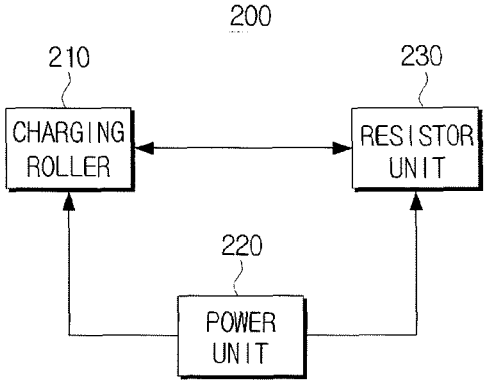
FIG. 2 is a block diagram illustrating a charging device according to an exemplary embodiment of the present general inventive concept.

FIG. 2 is a block diagram illustrating a charging device according to an exemplary embodiment of the present general inventive concept.

The charging device may include a charging member 210, a power unit 220, and a resistor unit 230.

The charging member 210 charges a photosensitive drum (not illustrated) that is used as a photoconductive medium, at a predetermined potential. In specific, the charging member 210 is in contact with a surface of the photosensitive drum, thereby maintaining a nip area on a contacting portion. The power is supplied to a roller shaft of the charging member 210 to charge the photosensitive drum surface. An outer surface of the charging member 210 may be made of a conductive rubber.

The power unit 220 generates a high voltage to charge the photosensitive drum at a constant potential. In specific, the power unit 220 supplies a DC bias power to a side of the charging member 210 to reduce a ripple of a charging potential from the photosensitive drum surface.

The resistor unit 230 is connected with a portion of a surface of the charging member 210 to reduce a ripple of the charging member surface. The resistor unit 230 may include one or more resistors having a high resistance, and is connected in parallel with the charging member 210 forming the charging potential. The parallel resistors can lower the voltage to be supplied to the charging unit 210, so that a potential value required for the charging potential is formed on the surface of the charging member 210. The resistance of the resistor unit 230 is determined by an image forming system to apply the resistor unit 230, and the resistor unit 230 may be implemented as one or more variable resistors to change a resistance thereof according various and variable environment.

As the potential voltage is injected through the resistor unit 230 to be applied to the surface of the charging member 210, in addition to a discharge potential voltage generally applied to the charging member 210, the potential ripple on the charging member surface is reduced.

Figure 3:
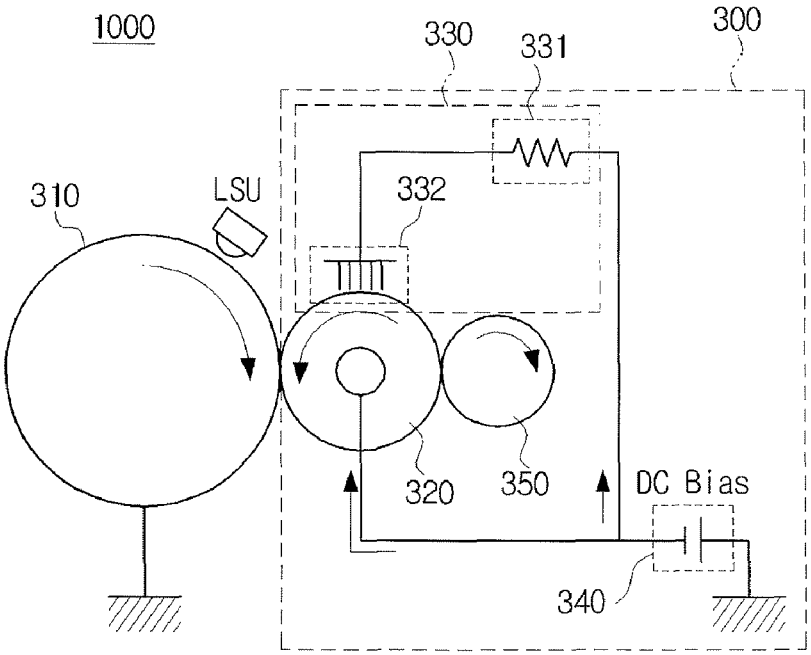
FIG. 3 is a view illustrating an image forming apparatus to perform a charging operation according to an exemplary embodiment of the present general inventive concept.

FIG. 3 is a view illustrating an image forming apparatus 1000 to perform a charging operation according to an exemplary embodiment of the present general inventive concept.

Referring to FIG. 3, the image forming apparatus 1000 may include a photoconductive medium 310 and a charging device 300.

The charging device 300 of FIG. 3 corresponds to the charging device 200 of FIG. 2. The charging device 300 may comprise a charging member 320, a resistor unit 330, a direct current (DC) bias unit 340, and a cleaning member 350.

The photoconductive medium 310 is charged to have the same polarization as that of an electric charge of a toner that is supplied to a latent image of the photoconductive medium 310.

The charging member 320 charges the photoconductive medium 310 at a predetermined potential. That is, the charging member 320 receives the DC bias voltage, and charges the photoconductive medium 310 to have a voltage of −600V using the DC bias voltage unit 340.

The resistor unit 330 may include a resistor 331 and a conductive member 332. The resistor 331 has a resistance computed considering a resistance of the charging member 320 and the photoconductive medium 310, so that the charging potential of the photoconductive medium 310 keeps a constant potential.

The conductive member 332 connects the charging member 320 with the resistor 331. The charging member 320 is formed in a circular roller configuration, and the conductive member 332 may be shaped like a brush in order to continuously contact the surface of the charging member 320. The conductive member 332 is disposed to connect with a surface of the charging member 320 at a rear end of the cleaning member 350 based on a rotational direction thereof.

That is, the conductive member 332 is disposed on an upstream of a rotation path of the charging member 320 such that a surface of the charging member 320 contacts the conductive member 332 and then contacts the photoconductive medium 310 through the nip area.

The charging member 320 may have a first portion, for example, a shaft, to be supplied with a first potential from the DC bias unit 340 and a second portion, for example, an outer surface, to be supplied with another potential from the DC bias unit 340 through the resistor unit 331. The first portion of the charging member 320 is in contact with a terminal of the DC bias unit 340, and the second portion of the charging member 320 is in area contact with a terminal of the conductive element 332. An area of the conductive element to be in contact with the second portion of the charging member 320 has a length along a surface of the charging member 320 in a rotation path and a width to correspond to a width of the charging member 320 in a direction parallel to a rotation axis of the charging member 320.

The charging member 320 may have a medium disposed between the first portion and the second portion to have a resistance to generate a potential therebetween.

The cleaning member 350 removes contaminants from the charging member 320. The contaminants such as developer or paper powder scattered or floating in a cartridge stick to the surface of the charging member 320, thereby contaminating the charging member 320. The contaminants remain at the charging member 320 to which no cleaning device is provided, thereby causing the charging ununiformity of the photoconductive medium 310. The charging ununiformity causes a faulty image (poor image or lower quality image). The cleaning member 350 is connected with a side of the charging member 320 to improve such faulty image, and is disposed to contact a surface of the charging member 320 after finishing the charging operation based on the rotation direction of the charging member 320. Accordingly, the developer remaining on the surface of the charging member 320 is removed by the rotation of the cleaning member 350.

Figure 4:
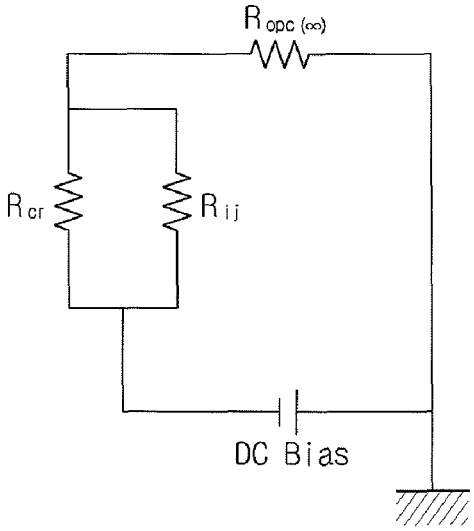
FIG. 4 is a circuit diagram illustrating the image forming apparatus of FIG. 3

FIG. 4 is a circuit diagram illustrating a modeling structure of the image forming apparatus of FIG. 3.

Referring to FIGS. 3 and 4, a symbol $R_{opc}$ represents the resistance of the photoconductive medium 310, $R_{cr}$ represents the resistance of the charging member 320, and $R_{ij}$ represents the resistance added to the charging device 300 according to the exemplary embodiment of the present general inventive concept.

A conventional image forming apparatus may be similar to the circuit illustrated in FIG. 4, except the resistance ($R_{ij}$). As the $R_{ij}$ has to maintain the previous surface potential, the $R_{ij}$ is determined by the surface potential of the photoconductive medium 310. $R_{ij}$ may be computed by mathematical Formulae 1, 2, and 3.

$$V_{DC}=V_{opc}+V_{ij}(=V_{cr})\text{where} \quad \text{[Formula 1]}$$

$V_{DC}$=DC bias voltage, $V_{opc}$=potential difference occurring at a the photoconductive medium $V_{cr}$=potential difference occurring at a charging-transfer roller, that is, the discharge charging voltage, and $V_{ij}$=potential occurring at the surface of the charging-transfer roller, that is, injected charging voltage.

The potential difference Vcr is a difference between a terminal (shaft terminal) of the charging member 320 connected to the DC bias unit 340 and the surface of the charging member 320.

Referring to Formula 1, $V_{cr}$ is acquired by multiplying $R_{cr}$ by $I_{cr}$, and $V_{ij}$ is computed by multiplying $R_{ij}$ by $I_{ij}$. Accordingly, Formula 1 is also represented as Formula 2.

$$V_{DC}=I_{cr}*R_{cr}+I_{ij}*R_{ij} \quad \text{[Formula 2]}$$

As $R_{ij}$ is added to maintain a previous surface potential, the injected charging voltage is the same as the surface potential of the photoconductive medium. These relation is represented as $V_{ij}=Vo=I_{ij}*R_{ij}$. Current $I_{ij}$ is also expressed as $I_{ij}$=Constant, and $V_{ij}=V_{DC}/R_{ij}^{2}$, because current $I_{ij}$ is used to keep voltage Vo constant. Accordingly, Formula 2 is represented as Formula 3.

$$R_{ij}=V_{DC}/Vo \quad \text{[Formula 3 ]}$$

Accordingly, the added resistance is computed using Formula 3.

For example, if the DC bias has a voltage of −1200V, and the surface potential has a voltage of −600V, the system resistance should be 20MΩ, and a voltage $V_{ij}$ on the surface should be 600V. Therefore, an element, such as a brush, having lower than a surface resistance 20 Ω may be used as a conductive member to use a voltage on the roller surface.

Accordingly, while the power is supplied to the charging member at the charging DC voltage, the DC power is supplied to the surface of the charging member through $R_{ij}$ and the conductive member. That is, as the injected charging as well as the discharge charging by the charging member is applied to the surface of the charging member, potential ripple on the photoconductive medium surface is stabilized. As a result, the ripple of the charging potential is obviated, so that the image faulty is improved.

As the charging apparatus according to the exemplary embodiment of the present general inventive concept enhances a stability of charging potential using resistors, the stable charging potential can be supplied to a photoconductive medium without requiring additional power device. Therefore, an image of satisfactory quality is output.

Furthermore, the stable charging potential is applied, so that it is possible to embody an image forming apparatus which outputs a satisfactory quality image at high speed or with a high resolution.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A charging apparatus, comprising:

a charging member to charge a surface of a photoconductive medium;

a power unit to supply an electric power to the charging member; and a resistor unit to reduce a ripple on the surface of the charging member, wherein the resistor unit is connected in parallel with the charging member.

2. The apparatus of claim 1, wherein the power unit is an electric power source in which an end is connected with a conductive member facing with the charging member and a rotation axis of the charging member.

3. The apparatus of claim 1, further comprising:

a cleaning member to clean the surface of the charging member; and a conductive member facing with the charging member at a rear end of the cleaning member based on a rotational direction of the charging member.

4. An image forming apparatus, comprising:

a photoconductive medium; and a charging apparatus that an electric power is supplied to a charging member to charge the photoconductive medium, and to reduce a ripple of the charging member, wherein the charging apparatus comprises a resistor unit connected in parallel with the charging member.

5. The apparatus of claim 4, wherein the charging apparatus is an electric power source in which an end is connected with a conductive member facing with the charging member and a rotation axis of the charging member.

6. The apparatus of claim 4, further comprising:

a cleaning member to clean the surface of the charging member; and a conductive member at facing with the charging member a rear end of the cleaning member based on a rotational direction of the charging member.

7. A charging apparatus usable with an image forming apparatus, comprising:

a charging member; and a power device to supply a first electric power to a first portion of the charging member and to supply a second electric power to a second portion of the charging member, wherein the charging member has a resistance between the first portion and the second portion, and wherein the power device comprises a resistor unit connected in parallel to the resistance.

8. The charging apparatus of claim 7, wherein the first portion of the charging member comprises a shaft terminal to receive the first electric power of the power device.

9. The charging apparatus of claim 7, wherein the second portion of the charging member comprises a surface to receive the second electric power of the power device.

10. The charging apparatus of claim 7, wherein the power device comprises a DC bias unit to generate the first electric power to be supplied to the first portion of the charging member, and the resistor unit reduces the first electric power of the DC bias unit to the second electric power to be supplied to the second portion of the charging member.

11. The charging apparatus of claim 7, wherein the power device comprises a conductor member through which the second electric power of the power device is supplied to the second portion of the charging member.

12. The charging apparatus of claim 7, wherein the power device comprises a conductor member being in area contact with the second portion of the charging member to supply the second electric power to the second portion of the charging member.

13. The charging apparatus of claim 7, wherein the power device comprises a brush disposed to contact the second portion of the charging member.

14. The charging apparatus of claim 7, wherein the second portion of the charging member comprises an outer surface to contact an external photoconductive medium through a nip area, and the power device comprises a conductive element having an area disposed along the outer surface of the charging member.

15. The charging apparatus of claim 14, wherein the conductive element has a width to correspond to a width of the charging member in a direction parallel to a rotation axis of the charging member.

16. The charging apparatus of claim 7, wherein the first portion of the charging member comprises a shaft to rotate with respect to a rotation axis thereof to be in point contact with the power device to receive the first electric power, and the second portion of the charging member comprises a surface to be in area contact with the power device to receive the second electric power.

17. The charging apparatus of claim 7, wherein the second portion of the charging member is in contact with a photoconductive medium to charge a surface of the photoconductive medium with a potential using the first electric power and the second electric power, and the second electric power is supplied to the second portion of the charging member to reduce ripple of the potential of the surface of the photoconductive medium.

18. The charging apparatus of claim 7, wherein the second portion of the charging member contacts the power device to receive the second electric power and then contacts an external photoconductive medium through a nip area to reduce an electrical ripple of a surface of the photoconductive medium.

19. The charging apparatus of claim 7, wherein the charging member comprises a medium disposed between the first portion and the second portion, and the second portion of the charging member is supplied with the first electric power through the medium and with the second electric power through a conductive medium.

20. The charging apparatus of claim 7, wherein the power device simultaneously supplies the first electric power and the second electric power to the first portion and the second portion, respectively.

* * * * *